US009238259B2

(12) United States Patent
Röse et al.

(10) Patent No.: US 9,238,259 B2
(45) **Date of Patent: *Jan. 19, 2016**

(54) METHOD AND DEVICE FOR WINDING HOT-ROLLED STRIP

(75) Inventors: Heinrich Röse, Hilchenbach (DE); Olaf Norman Jepsen, Siegen (DE); Heinz Niehues, Hilchenbach (DE); Heinz-Adolf Müller, Wilnsdorf (DE)

(73) Assignee: SMS GROUP GMBH, Düsseldorf (DE)

( * ) Notice: Subject to any disclaimer, the term of this patent is extended or adjusted under 35 U.S.C. 154(b) by 669 days.

This patent is subject to a terminal disclaimer.

(21) Appl. No.: 12/450,129

(22) PCT Filed: Mar. 28, 2008

(86) PCT No.: PCT/EP2008/002511

§ 371 (c)(1),
(2), (4) Date: Sep. 11, 2009

(87) PCT Pub. No.: WO2008/116666

PCT Pub. Date: Oct. 2, 2008

(65) Prior Publication Data

US 2011/0138870 A1 Jun. 16, 2011

(30) Foreign Application Priority Data

Mar. 28, 2007 (DE) ..... 10 2007 014 748
Mar. 28, 2008 (DE) ..... 10 2008 016 314

(51) Int. Cl.
*B21C 47/14* (2006.01)
*B21C 47/06* (2006.01)
*B21C 47/04* (2006.01)

(52) U.S. Cl.
CPC ..... *B21C 47/063* (2013.01); *B21C 47/14* (2013.01); *B21C 47/045* (2013.01)

(58) Field of Classification Search
CPC ..... B21C 47/063; B21C 47/06; B21C 47/02; B21C 47/10; B21C 47/12; B21C 47/14; B21C 47/04
USPC ..... 72/146–148, 205
See application file for complete search history.

(56) References Cited

U.S. PATENT DOCUMENTS

| | | | | |
|---|---|---|---|---|
| 1,258,091 | A * | 3/1918 | Clark | 72/146 |
| 3,988,916 | A | 11/1976 | McGeeney | |
| 4,288,041 | A * | 9/1981 | Marzec et al. | 242/434.7 |
| 4,845,971 | A * | 7/1989 | Roder et al. | 72/146 |
| 5,966,978 | A | 10/1999 | Kneppe | |
| 6,327,883 | B1 * | 12/2001 | Noe et al. | 72/8.5 |
| 7,059,161 | B2 * | 6/2006 | Armenat et al. | 72/11.7 |

FOREIGN PATENT DOCUMENTS

| | | |
|---|---|---|
| DE | 24 14 475 | 10/1975 |
| DE | 24 14 482 | 10/1975 |
| EP | 0 469 483 | 2/1992 |
| EP | 0790084 | 8/1997 |
| GB | 1026941 | 4/1966 |
| JP | 58032521 | 2/1983 |
| JP | 58058931 | 4/1983 |
| JP | 59064116 | 4/1984 |

* cited by examiner

*Primary Examiner* — Shelley Self
*Assistant Examiner* — Matthew G Katcoff
(74) *Attorney, Agent, or Firm* — Lucas & Mercanti, LLP; Klaus P. Stoffel

(57) ABSTRACT

In a method for winding hot-rolled strip (1), comprising —a decoiler mandrel (4), —at least one first pressing device (7), —at least one second pressing device (8), wherein the hot-rolled strip (1) is pressed from the first pressing device (7) and the second pressing device (8) toward the decoiler mandrel (4), the hot-rolled strip (1) is pushed or pulled away from the decoiler mandrel (4) between the first pressing device (7) and the second pressing device (8), thereby subjecting the hot-rolled strip (1) to a prebending step. The invention further relates to a device for winding hot-rolled strip (1).

9 Claims, 2 Drawing Sheets

METHOD AND DEVICE FOR WINDING HOT-ROLLED STRIP

The invention concerns a method for coiling hot-rolled strip with a coiler mandrel, at least a first pressing device, at least a second pressing device, wherein the hot-rolled strip is pressed towards the coiler mandrel by the first pressing device and the second pressing device. The invention also concerns a device for coiling hot-rolled strip.

Hot-strip coilers are installed at the end of hot strip mills and are used to coil hot-rolled strip into coils after the rolling operation. The strip is coiled under tensile stress to produce a sufficiently tightly coiled coil and to prevent the coil from springing open after the coiling operation has been completed. The tensile stress is also necessary to bend the strip around the coiler mandrel and thus to cause plastic deformation of the strip. Especially where thick strip is concerned, large tensile loads are necessary to overcome the plastic bending moment.

During the coiling operation, the strip is driven by a driver, which consists of an upper drive roll and a lower drive roll, and conveyed to a coiler mandrel. The strip is coiled around the mandrel with the aid of pressing rolls, and a coil is formed, which is removed from the mandrel after the strip has been completely coiled. During the coiling, a predetermined tensile stress is adjusted between the driver and the coiler mandrel.

EP 0 469 483 discloses hot-strip coilers in which the strip is pressed against a mandrel by four pressing rolls.

JP 58 058 931 A discloses a coiler in which the strip that is to be coiled is pressed against a mandrel by three adjustable pressing rolls. Each pressing roll is rotated about its own center of rotation by its own hydraulic cylinder.

To ensure that the leading end of the strip is already in complete contact with the mandrel and that the first windings of the strip form a frictional connection, DE 24 14 482 B2 proposes that the thickness of the strip be reduced by at least 20% at its leading end. The leading end of the strip is thus provided with a thickness that allows its to be laid completely against the mandrel and the first windings. After the first windings are frictionally connected with one another or are resting one upon the other, the thickness of the strip is adjusted to specifications and increased. A procedure of this type is also disclosed by DE 24 14 475 A1.

Methods and devices for coiling hot-rolled strip are also known from EP 0 790 084 B1 and JP 59064116 A.

For strip with a thickness of 7 mm or more, low coiling temperatures and relatively high-strength grades, e.g., tube material, large strip tensions are necessary. However, despite the high strip tensions, the strip is not laid directly on the mandrel and on the first windings of the coil, but rather is bent over a relatively long distance before it comes into contact with the coil.

Therefore, the objective of the invention is to specify a method by which a hot-rolled strip with a thickness of 7 mm or more, low coiling temperatures and relatively high-strength grades, such as tube material, lies completely against the coiler mandrel from the very beginning of the coiling operation and subsequently lies completely against the windings that have already been produced. The invention also concerns a device for coiling hot-rolled strip.

In accordance with the invention, this objective is achieved with a method of the general type described above, in which a prebending device between the first pressing device and the second pressing device pushes and pulls the hot-rolled strip away from the coiler mandrel and thus subjects the hot-rolled strip to a prebending operation.

The prebending operation on the hot-rolled strip has two important results. First, the hot-rolled strip lies completely against the coiler mandrel from the very start of the coiling operation and against the subsequent windings. Second, the prebending operation allows coiling with less strip tension, since the hot-rolled strip is deformed not only by the pressing devices but also by the prebending device.

Further embodiments of the method are described in the associated dependent claims.

The invention also concerns a device for coiling hot-rolled strip with a coiler mandrel, at least a first pressing device, at least a second pressing device, wherein the hot-rolled strip is pressed towards the coiler mandrel by the first pressing device and the second pressing device, and wherein a prebending device is arranged between the first pressing device and the second pressing device, is in contact with the inside surface of the hot-rolled strip that is being coiled, and deforms the hot-rolled strip radially outward, away from the coiler mandrel. The hot-rolled strip is deformed in such a way that it is given a radius that is equal to or somewhat smaller than the radius of the coiler mandrel. The hot-rolled strip lies against the coiler mandrel from the very beginning of the coiling operation or, due to the pretension resulting from the somewhat smaller radius, is pressed completely against the coiler mandrel by the pressing devices.

Further embodiments of the device are described in the associated dependent claims. Closed-loop/open-loop control of the coiling of the hot-rolled strip is designed in such a way that a prebending device arranged between the first and second pressing devices is moved towards or away from the coiler mandrel in such a way that, depending on the coil diameter, the thickness of the hot-rolled strip, the grade of the hot-rolled strip and/or the temperature of the hot-rolled strip, it is always guaranteed that the hot-rolled strip will lie against the coiler mandrel at the start of the coiling operation. To this end, the prebending device can be moved both towards and away from the coiler mandrel. In addition, the distance of the prebending device from the first pressing device and from the second pressing device can be varied. All together, this results in the possibility of positioning the prebending device in a plane perpendicular to the surface of the strip. To this end, the prebending device is equipped with a first pulling or pushing device, which moves the prebending device towards or away from the coiler mandrel. At least a second pulling or pushing device is arranged in such a way that the prebending device is moved towards or away from the first pressing device or the second pressing device. The given position of the prebending device relative to the coiler mandrel, the first pressing device and the second pressing device depends in each case on the thickness of the hot-rolled strip, the grade of the hot-rolled strip, and the temperature of the hot-rolled strip. These values, which are to be measured or determined in advance, are read/input into a computer program of an open loop/closed-loop control system, and the position of the prebending device at the beginning of the coiling operation is determined. Since as the coil diameter increases, the radius in the prebending operation also increases, the prebending device is moved towards the coiler mandrel. After the coiling operation, when the last winding of the hot-roll strip lies against the coil, the prebending device is removed from the coil. This can be done both in the direction of strip travel and perpendicularly to the direction of strip travel. The prebending device has no effect on the removal of the coil from the coiler mandrel.

In an alternative design of the open-loop/closed-loop control system, the tensile load during the coiling of the hot-rolled strip is considered instead of the position of the prebending device. Well-known devices for determining the strip tension are used for this purpose, and the prebending device is subjected to open-loop/closed-loop control on the basis of the values thus determined.

A specific embodiment of the invention is explained in greater detail below with reference to the highly schematic drawings.

Figure 1:
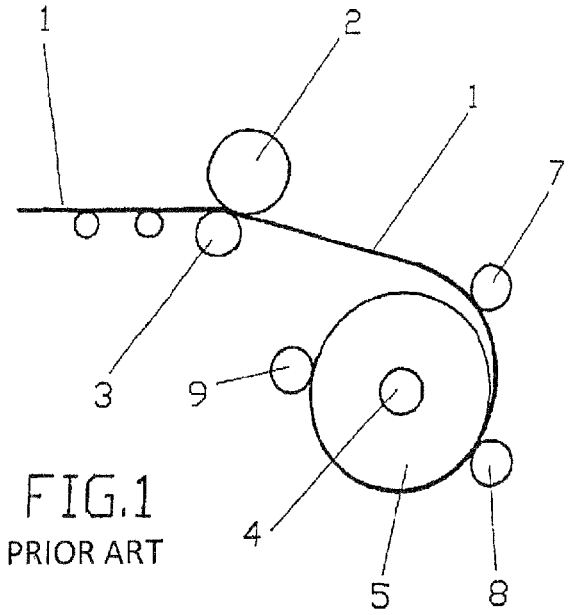
FIG.1 PRIOR ART
FIG. 1 shows a side view of a prior-art hot-strip coiler.

FIG. 1 shows a side view of a previously known device for coiling hot-rolled strip 1. The hot-rolled strip 1, which comes from a rolling stand (not shown), is passed between an upper drive roll 2 and a lower drive roll 3 and from there is conveyed to a coiler mandrel 4. To press the hot-rolled strip 1 against the coiler mandrel 4, several pressing devices 7, 8, 9 are arranged around the coiler mandrel 4. When hot-rolled strip 1 made of relatively high-strength grades of steel and/or hot-rolled strip 1 with a thickness of 7 mm or more is being coiled, the hot-rolled strip 1 is not laid directly against the coiler mandrel 4. Frictional connection between the coiler mandrel 4 and the hot-rolled strip 1 is not established until the hot-rolled strip 1 has reached an angle of wrap of 180° or more. In other words, the hot-rolled strip 1 is separated from the coiler mandrel 4 at the beginning of the coiling operation, and tensile stress has not developed in the hot-rolled strip 1 between the drive rolls 2, 3 and the coiler mandrel 4. In addition, the diameter of the eye of the coil, i.e., the inside diameter of the coiled hot-rolled strip 1, differs from the diameter predetermined by the coiler mandrel 4.

Figure 2:
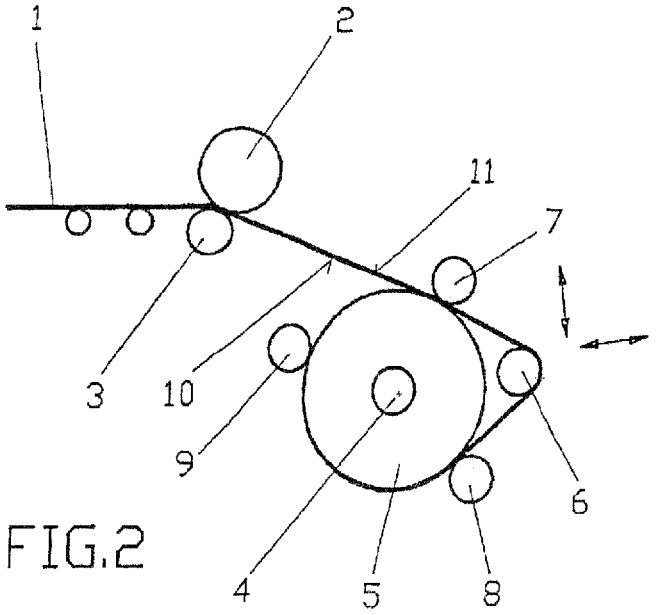
FIG. 2 shows a side view of a hot-strip coiler in accordance with the invention.

FIG. 2 shows a device of the invention for coiling hot-rolled strip 1. The parts of the device known from the prior art are also used here and have the same reference numbers. The hot-rolled strip 1, which is conveyed to the coiler mandrel 4 by the upper drive roll 2 and the lower drive roll 3, is pressed radially towards the coiler mandrel 4 by the first pressing device 7. Before the hot-rolled strip 1 is pressed by the second pressing device 8, likewise radially towards the coiler mandrel 4, it is pressed radially outward from the coiler mandrel 4 by a prebending device 6. In this regard, the prebending device 6 is arranged on the inside surface 10 of the coiling strip between the coiler mandrel 4 and the hot-rolled strip 1, while the pressing devices 7, 8 and 9 are in contact with the outside surface 11 of the hot-rolled strip 1 that is being coiled. The prebending device 6 bends the hot-rolled strip 1 to the same curvature as or to a greater curvature than the hot-rolled strip 1 would normally require in order to lie on the coiler mandrel 4. The prebending operation on the hot-rolled strip 1 has two important results. First, the hot-rolled strip 1 lies completely against the coiler mandrel 4 from the very start of the coiling operation and against the subsequent windings. Second, the prebending operation allows coiling with less strip tension, since the hot-rolled strip 1 is deformed not only by the pressing devices 7, 8 and 9 but also by the prebending device 6.

Figure 3:
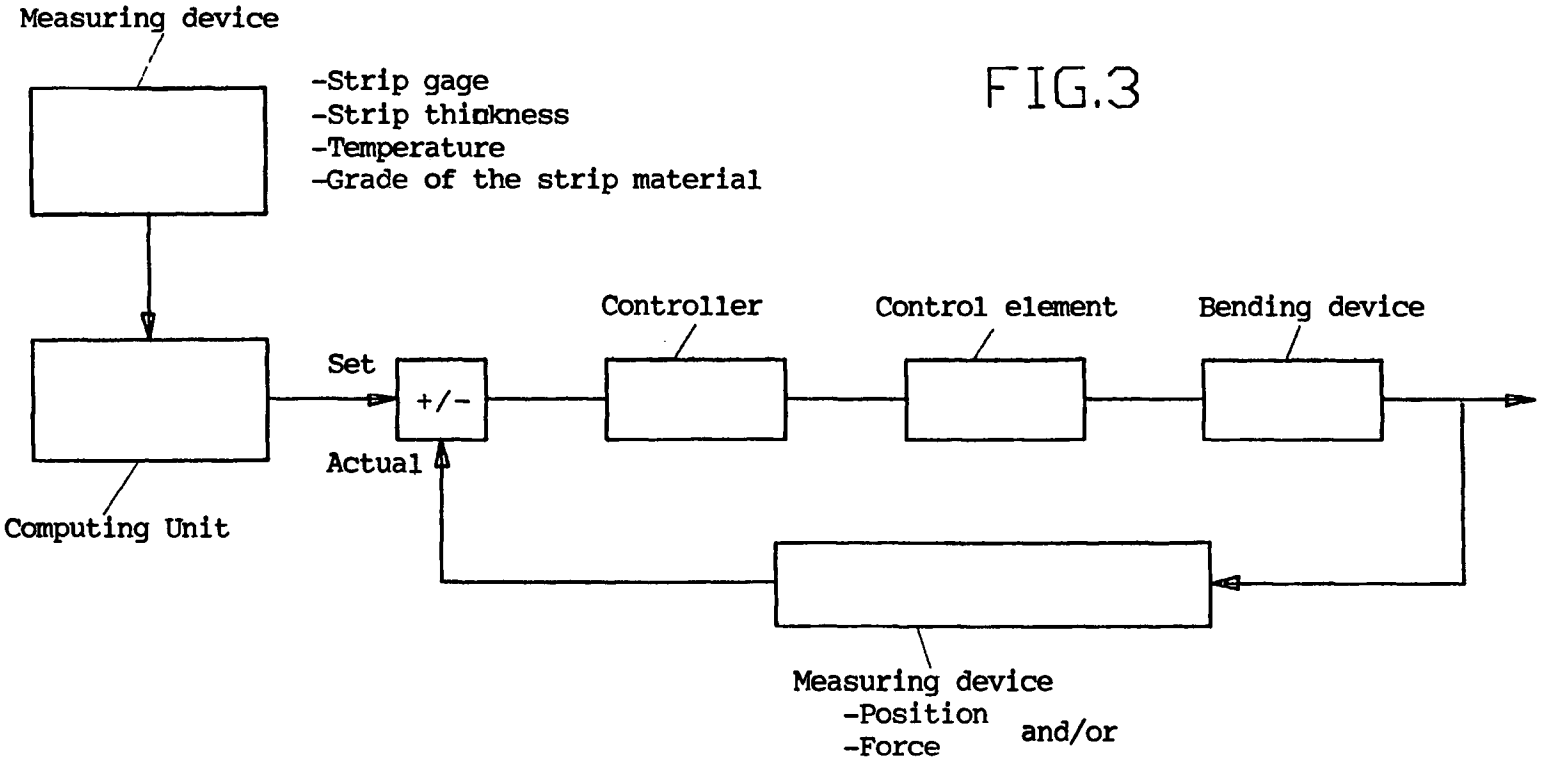
FIG. 3 is a diagram of the automatic control system of the device.

FIG. 3 is a diagram of the automatic control system. A measuring device determines the coil diameter, the strip thickness, the temperature of the hot-rolled strip and/or the grade of the material that is used. The set position or the set force of a prebending device 6 is determined from these parameters in a computing unit and is set by a control element. Another measuring device determines the actual position or the actual force, which is then compared with the set position or the set force and, if necessary, changed or adapted by the controller.

LIST OF REFERENCE NUMBERS

1 hot-rolled strip
2 upper drive roll
3 lower drive roll
4 coiler mandrel
5 coil
6 prebending device
7 first pressing device
8 second pressing device
9 pressing device
10 inside surface of the coiling strip
11 outside surface of the coiling strip

The invention claimed is:

1. A method for coiling hot-rolled strip (1), comprising the steps of:

providing a coiler mandrel (4);

providing at least a first pressing device (7);

providing at least a second pressing device (8) so that the second pressing device is spaced from the first pressing device in a circumferential direction of the coiler material;

where the hot-rolled strip (1) is pressed against the coiler mandrel (4) by the first pressing device (7) and the second pressing device (8); and, a prebending device between the first pressing device (7) and the second pressing device (8), the prebending device pushes or pulls the hot-rolled strip (1) radially away from the coiler mandrel (4) by a force acting on the inside surface (10) of the hot-rolled strip (1) that is being coiled and thus subjecting the hot-rolled strip to prebending.

2. A method in accordance with claim 1, wherein the hot-rolled strip (1) is subjected to prebending during the entire coiling operation.

3. A method in accordance with claim 1, wherein the hot-rolled strip (1) is prebent at the beginning of the coiling operation.

4. A method in accordance with claim 1, wherein the position of the prebending device (6) with respect to the hot-rolled strip (1) and/or the force with which the prebending device (6) pushes against the hot-rolled strip (1) is automatically controlled by suitable means during the coiling operation.

5. A device for coiling hot-rolled strip (1) with a coiler mandrel (4), at least a first pressing device (7), at least a second pressing device (8) spaced from the first pressing device in a circumferential direction of the coiler mandrel, a third pressing device arranged after the first and second pressing devices in the circumferential direction of the coiler mandrel, where the first pressing device, the second pressing device and the third pressing device are arranged after one another in the circumferential direction of the coiler mandrel so as to press the hot-rolled strip (1) against the coiler mandrel (4), and a prebending device (6), which is in contact with the inside surface (10) of the hot-rolled strip (1) that is being coiled, is arranged between and spaced from the first pressing device (7) and the second pressing device (8) in the circumferential direction of the coiler mandrel so that the prebending device pushes or pulls the hot rolled strip between the first pressing device and the second pressing device so as to apply a radial force directed radially outward, away from the coiler mandrel (4) and against an inside surface of the hot-rolled strip so that the hot-rolled strip (1) is deformed.

6. A device in accordance with claim 5, comprising an automatic control device for automatically controlling the position of the prebending device in relation to the hot-rolled strip (1) by means of a control element and/or for automatically controlling the force with which the prebending device (6) is pushed against the hot-rolled strip (6).

7. A device in accordance with claim 6, comprising a measuring device for determining parameters, such as the coil diameter, the strip thickness, the grade of the strip material, or the temperature of the hot-rolled strip (1); and by a computing unit with a computer program for determining a setpoint value for the automatic control of the position or the force of the prebending device (6) during the coiling of the coil as a function of the magnitude of the determined parameters.

8. A device in accordance with claim 6, wherein the control element is designed as a pushing or pulling device for suitably positioning a prebending device (6) in a plane perpendicular to the surface of the strip in relation to the coiler mandrel (4) or the coil that is being produced as a function of the determined parameters.

9. A device in accordance with claim 6, wherein the control element is designed to move the prebending device (6) out of the line of the hot-rolled strip (1) during or after the coiling of the hot-rolled strip (1).

* * * * *